US009732429B2

(12) United States Patent
Link

(10) Patent No.: US 9,732,429 B2
(45) Date of Patent: Aug. 15, 2017

(54) ALKENYL SUCCINIC ACIDS OR ANHYDRIDES AS CORROSION INHIBITORS FOR METAL SURFACES

(71) Applicant: General Electric Company, Schenectady, NY (US)

(72) Inventor: John Link, The Woodlands, TX (US)

(73) Assignee: General Electric Company, Schenectady, NY (US)

( * ) Notice: Subject to any disclaimer, the term of this patent is extended or adjusted under 35 U.S.C. 154(b) by 27 days.

(21) Appl. No.: 14/443,733

(22) PCT Filed: Nov. 29, 2012

(86) PCT No.: PCT/US2012/067011

§ 371 (c)(1),
(2) Date: May 19, 2015

(87) PCT Pub. No.: WO2014/084828

PCT Pub. Date: Jun. 5, 2014

(65) Prior Publication Data

US 2015/0308000 A1 Oct. 29, 2015

(51) Int. Cl.

| | |
|---|---|
| ***C23F 11/00*** | (2006.01) |
| ***C23F 11/04*** | (2006.01) |
| ***B08B 9/00*** | (2006.01) |
| ***C10G 75/02*** | (2006.01) |
| ***C23F 11/12*** | (2006.01) |
| ***C23G 1/06*** | (2006.01) |
| ***C10G 29/20*** | (2006.01) |

(52) U.S. Cl.

CPC ..... *C23F 11/04* (2013.01); *C10G 29/205* (2013.01); *C10G 75/02* (2013.01); *C23F 11/126* (2013.01); *C23G 1/06* (2013.01)

(58) Field of Classification Search

CPC ..... A61L 2/00; C22F 1/00
USPC ..... 422/7, 12; 252/175, 387; 134/22.1
See application file for complete search history.

(56) References Cited

U.S. PATENT DOCUMENTS 3,676,514 A 7/1972 Rosenthal
4,422,953 A 12/1983 Grace et al.
(Continued)

FOREIGN PATENT DOCUMENTS

CA 1085154 A1 9/1980
GB 1036589 A 7/1966
(Continued)

OTHER PUBLICATIONS

International Search Report issued in connection with corresponding PCT application PCT/US2012/067011 dated Aug. 21, 2013.

*Primary Examiner* — Monzer R Chorbaji
(74) *Attorney, Agent, or Firm* — Wegman, Hessler & Vanderburg

(57) ABSTRACT

Methods of inhibiting corrosion in a benzene distillation or dryer unit are provided wherein alkenyl succinic acids or anhydrides (ASA) are brought into contact with metal surfaces thereby protecting the metal from an acidic corrosive medium flowing through the overhead. The benzene distillation column or drying tower may be utilized to purify benzene for subsequent feed of the purified benzene to an alkylation process such as in the alkylation of benzene by ethene to form ethylbenzene utilizing a zeolite alkylation catalyst.

11 Claims, 1 Drawing Sheet

(56) References Cited

U.S. PATENT DOCUMENTS

| | | | | |
|---|---|---|---|---|
| 4,508,637 | A | 4/1985 | Heintzelman | |
| 5,851,419 | A | 12/1998 | Miyake et al. | |
| 5,998,684 | A | 12/1999 | Ho et al. | |
| 6,867,171 | B2 | 3/2005 | Harrison et al. | |
| 7,455,751 | B2 | 11/2008 | Ward et al. | |
| 2008/0202561 | A1 | 8/2008 | Dumont | |
| 2009/0061234 | A1* | 3/2009 | Stark ..... | C10G 75/02<br>428/411.1 |

FOREIGN PATENT DOCUMENTS

| | | | |
|---|---|---|---|
| WO | 2008094255 | A1 | 8/2008 |
| WO | WO2008094255 | A1 | 8/2008 |

* cited by examiner

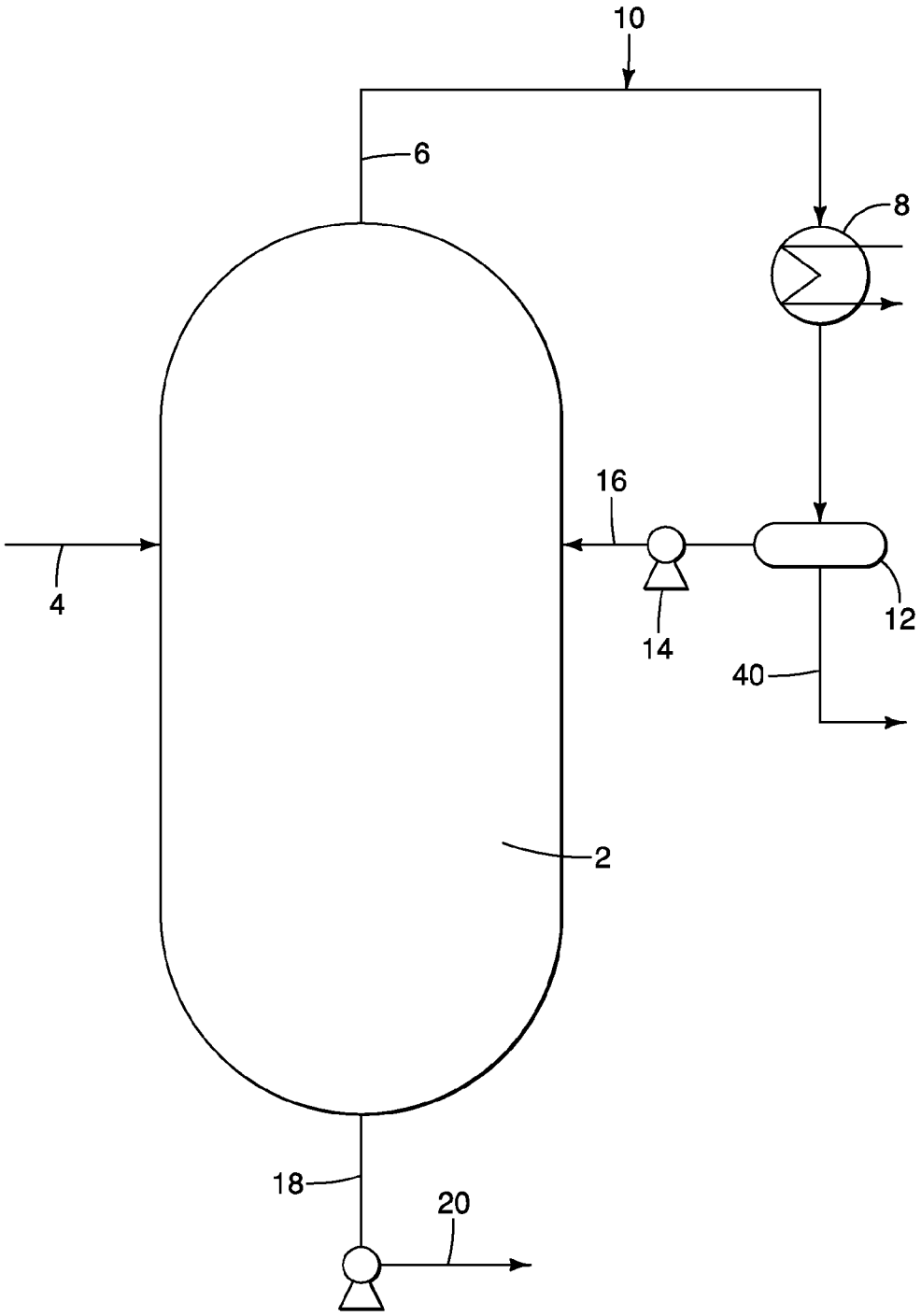
10
6
8
16
4
14
12
40
2
18
20

ALKENYL SUCCINIC ACIDS OR ANHYDRIDES AS CORROSION INHIBITORS FOR METAL SURFACES

FIELD OF INVENTION

Embodiments of the present invention relate to methods of inhibiting corrosion in benzene drying towers and chemical process reactors by feeding alkenylsuccinic acids or anhydrides (ASA) to contact the corrosive media contained in the tower or reactor.

BACKGROUND OF THE INVENTION

Benzene drying columns or towers are commonly employed to purify benzene for use in processes such as the alkylation of benzene to ethylbenzene (EB). In some cases, the benzene supply contains chloride salts and organic chlorine compounds. The chloride salts hydrolyze in the direct fired heater or reboiler of the tower in the presence of water. The organo chlorine compounds can undergo nucleophilic substitution, in the presence of water, to form an alcohol and HCl. The HCl and water then travel to the overhead due to their boiling points. If untreated, the overhead lines from such benzene columns or towers are highly corrosive resulting in damage to the overhead conduits, and to condensers, heat exchangers, pumps, accumulators and the like that are in fluid communication with such conduits.

Typically, corrosion inhibitors that may be employed are amines or amine based to neutralize the corrosive acidic species. The amine based filming corrosion inhibitors form a protective barrier on the metal surfaces of the tower and ancillary equipment. Unfortunately, these nitrogen containing products poison zeolite catalysts that are often employed in the benzene alkylation processes. The present invention is directed toward the provision of effective corrosion inhibition with a non-nitrogen containing inhibitor that will not adversely affect zeolite catalysts functioning in downstream processes such as the alkylation of benzene with ethylene to form EB. The production of EB is commercially important as it is a precursor for styrene monomer.

SUMMARY OF THE INVENTION

In one exemplary aspect of the invention, a method is provided for inhibiting corrosion of metal surfaces in contact with an acidic corrosive medium. An effective amount of an alkenylsuccinic acid or anhydride (both acid and anhydride form being referred to herein as "ASA") is added to the corrosive acidic medium. In certain embodiments, from about 1-500 ppm of the ASA is added to the corrosive acidic medium based upon 1 million parts of that medium. In further aspects of the invention, the ASA is devoid of nitrogen.

Generally, the ASAs are reaction products of $C_8$-$C_{32}$ olefins or mixtures thereof with maleic acid or anhydride. In certain embodiments of the invention, the olefin may be a $C_{12}$, $C_{16}$, $C_{18}$ olefin or mixtures thereof.

The acidic corrosive medium may comprise the benzene stream in the overhead section of a benzene drying column or the like. Typically, the corrosive acidic medium comprises predominantly gaseous benzene with low levels of water vapor and corrosive species such as HCl contained therein. Commonly these media have an acidic pH of about 1-7, and in some instances, these corrosive media have a highly acidic pH range of about 2 or less.

The benzene drying tower may be adapted to purify benzene for subsequent feed of the purified benzene to a downstream chemical process such as a benzene alkylation reactor for formation of ethylbenzene (EB) from the purified benzene reactant and an ethylene reactant. In these reaction schemes, the reactants are brought into contact with a zeolite catalyst.

Embodiments of the invention will be described further in conjunction with the appended, illustrative drawing.

BRIEF DESCRIPTION OF THE DRAWING

FIG. 1 is a schematic diagram of a benzene drying and light end removal tower in which the corrosion inhibiting treatment of an embodiment of the invention may be employed.

DETAILED DESCRIPTION

In one exemplary embodiment of the invention, ASA are employed as corrosion inhibitors in benzene drying columns and the like wherein benzene is processed for purification and subsequent feed to a variety of processes. In one aspect, the purified benzene is fed to a reactor along with ethene, i.e., ethylene, for alkylation of benzene to ethyl benzene. These benzene alkylation processes may be performed in either the liquid or vapor phase and the reaction is usually aided by a catalyst, such as a zeolite catalyst. Since a portion of the corrosion inhibitor persists with the benzene fed to the process, the potential for catalyst poisoning increases. This poisoning problem is especially acute when nitrogen containing corrosion inhibitors or filming amines are used in the benzene drying tower. The ASAs used in accordance with an embodiment of the invention are nitrogen free, provide improved corrosion inhibition results, and do not poison the zeolite catalysts that are often employed in benzene alkylation processes and the like.

As to the ASA compounds that may be used as the corrosion inhibitors, these are typically prepared by an ene reaction involving heating a $C_8$-$C_{32}$ olefin or a mixture thereof with maleic anhydride. The mole ratio of olefin to maleic anhydride may be varied but typically is within the range of about 1:1-2:1. The reagents are heated and stirred at temperatures of about 180° C.-230° C. for several hours in an inert atmosphere. Details of the synthesis of the ASAs may be gleaned by review of U.S. Pat. No. 7,455,751 (Ward et al.) and U.S. Pat. No. 6,867,171 (Harrison et al.), both of which are incorporated by reference herein.

The anhydride forms of the ASA may be used, but in order to be effective, these should hydrolyze to the acid form. Such hydrolysis would normally occur in the overhead. The acid form of the ASA is, in an embodiment, preferred and is prepared via reaction of the olefin with an unsaturated acidic reagent. (See U.S. Pat. No. 6,867,171.) One of the unsaturated acidic reagents listed in the '171 patent is maleic acid or its anhydride. In addition to the unsaturated acidic reagents, a strong acid catalyst having a $pK_a$, of less than about 4 may also be employed in the reaction to form the acid form ASA.

Turning now to FIG. 1, there is shown a benzene dryer and light ends removal tower 2 of the type that may be used to provide and/or recycle benzene to a benzene alkylation reactor. As shown, benzene is fed to the tower through conduit 4. This feed may for example comprise a combined feed of recycled benzene with a fresh benzene supply from a commercial supplier. In many cases, when the benzene is supplied, it may be contaminated with ionic and covalent C1. The tower 2 acts primarily as a straightforward distillation tower wherein water vapor, light hydrocarbons, and benzene are removed in the overhead lines 6 and report to condenser 8 which forwards condensed benzene to the accumulator 12 then through pump 14 and line 16 so that the benzene is fed as reflux into the tower. Acidic water is removed from the accumulator via water draw off 40. In addition to the presence of benzene and water vapor, acidic corrosive species such as HCl are also present in the overhead line 6. Purified benzene exits as bottoms at 18 and is forwarded to the desired process such as a benzene alkylation process as shown at 20.

In an embodiment, the ASA corrosion inhibitor is fed to the overhead lines as shown at 10 upstream from the condenser. The corrosion inhibitor may be fed at from about 1-500 ppm, more particularly 10-80 ppm, and more particularly about 50 ppm of the corrosion inhibitor based upon 1 million parts of the mixed vapor/liquid phase present in the overhead. The corrosion inhibitor can also be fed to the reflux line 16.

In one aspect of the invention, the purified benzene exiting the tower at 18 is used as a feed to either a liquid or vapor phase benzene alkylation process. Commercial ethylbenzene (EB) is produced in these processes by zeolite or other catalysis systems. The zeolite systems are becoming more prevalent, and in these systems, the catalyst may be employed in both the alkylation and transalkylation reactors. Zeolite catalysts that are commonly used include acidic zeolite/alumina and y-zeolite/alumina and other zeolite based catalysts such as dealuminized mordenite, alumina/magnesium silicate, and zeolite beta/alumina.

Generally, the corrosion inhibition methods may be used in conjunction with a variety of processes in which benzene is purified or dried in a drying or distillation column with the so-purified benzene then fed to a reactor or the like in which a zeolite catalyst will be employed to contact the reactants. For example, in addition to feed of the purified benzene to a reactor for alkylation of benzene with ethene to form ethylbenzene, the corrosion inhibition method may be used in a benzene drying or distillation column adapted to feed benzene to a reactor in which a zeolite catalyst will be employed to alkylate benzene with propylene to form cumene.

An embodiment of the invention will now be described in conjunction with the following illustrative examples.

EXAMPLES

In order to demonstrate the corrosion inhibitor efficacy of the ASA reaction products, modified spindle tests were undertaken. The test medium consisted of 99% toluene and 1% distilled water. The pH of the distilled water was adjusted to 2.0 with HCl. The liquid was purged with N2 and maintained at 80° C. The spindles were immersed in the liquid medium for 1 hour and rotated therein at 300 rpm. Corrosion rate of the spindles were determined and are shown in Table I.

TABLE I

| Corrosion inhibitor (ppm) | | Corrosion Rate (mpy) |
|---|---|---|
| C-1 | 16 ppm | ≈25 |
| C-1 | 8 ppm | ≈45 |

TABLE I-continued

| Corrosion inhibitor (ppm) | | Corrosion Rate (mpy) |
|---|---|---|
| Ex-1 | 8 ppm | ≈25 |
| Ex-1 | 16 ppm | ≈8 |

C-1 crude tall oil dimer and trimer acids $C_{36}$-$C_{54}$
Ex-1 alkenyl succinic acid $C_{12}$

Field Trial

The corrosion rates of the overhead lines of a benzene drying and light ends removal tower of the type shown in FIG. 1 were taken. The overhead pH ranged from about 1-7 in the overhead and under the C-1 corrosion treatment program, corrosion rates of up to 300 mpy were experienced. When the pH approached about 2, the C-1 corrosion inhibitor could not control corrosion. The Ex-1 corrosion inhibition treatment was initiated and corrosion rates of about 0.1 mpy were experienced then even at pH of about 2.

The description provided hereinabove is intended to generally describe the features and some useful embodiments of the invention. However, it will be appreciated that modifications may be made to many aspects of the invention without departing from its scope and generalized objects.

What is claimed is:

1. In a process comprising a benzene drying column wherein purified benzene is removed as a first stream and a corrosive medium comprising gaseous benzene, water vapor, and HCl is removed as a second stream, the improvement comprising adding to said second stream a corrosion inhibiting treatment comprising from about 1-500 ppm of ASA based upon 1 million parts of said second stream, said process further comprising returning benzene from said second stream to said column as reflux.

2. The method as recited in claim 1, wherein said ASA is devoid of nitrogen.

3. The method as recited in claim 1, wherein said ASA is a reaction product of $C_8$-$C_{32}$ olefin or mixtures thereof with an unsaturated acidic reagent.

4. The method as recited in claim 3, wherein said unsaturated acidic reagent comprises maleic acid or anhydride.

5. The method as recited in claim 4, wherein said ASA is $C_{12}$, $C_{16}$, or $C_{18}$ or mixtures thereof.

6. The method as recited in claim 5, wherein said corrosive acidic medium has a pH of about 1-7.

7. The method as recited in claim 5, wherein said corrosive acidic medium has a pH of about 2.0 or less.

8. The method as recited in claim 3, wherein said corrosive acidic medium is in gas phase.

9. Process as recited in claim 1 further comprising feeding said first stream to a benzene alkylation process wherein a zeolite catalyst is employed in the production of an alkyl benzene.

10. Process as recited in claim 9 wherein said alkyl benzene is ethyl benzene.

11. Process as recited in claim 9 wherein said alkyl benzene is cumene.

* * * * *